US011889959B2

(12) United States Patent
Lee

(10) Patent No.: US 11,889,959 B2
(45) Date of Patent: Feb. 6, 2024

(54) SHOWER CURTAIN ROD CAPABLE OF ADJUSTING AN ANGLE

(71) Applicant: Song-Jyi Enterprise Corp., Xiushui Township, Changhua County (TW)

(72) Inventor: Wei-Yao Lee, Xiushui Township (TW)

(73) Assignee: Song-Jyi Enterprise Corp., Xiushui Township (TW)

( * ) Notice: Subject to any disclaimer, the term of this patent is extended or adjusted under 35 U.S.C. 154(b) by 220 days.

(21) Appl. No.: 17/571,719

(22) Filed: Jan. 10, 2022

(65) Prior Publication Data

US 2023/0218123 A1 Jul. 13, 2023

(51) Int. Cl.
*A47K 3/38* (2006.01)
*A47H 1/02* (2006.01)

(52) U.S. Cl.
CPC ..... *A47K 3/38* (2013.01); *A47H 1/02* (2013.01); *A47H 2001/0215* (2013.01)

(58) Field of Classification Search
CPC .... A47K 3/38; A47H 1/02; A47H 2001/0215; A47H 1/12; A47H 1/122; A47H 1/124; Y10T 403/32368
USPC ..... 248/292.12
See application file for complete search history.

(56) References Cited

U.S. PATENT DOCUMENTS 5,706,878 A * 1/1998 Guettler ..... A47H 1/02 160/369
6,688,479 B2 * 2/2004 Nei ..... A47H 1/022 248/265
7,987,534 B2 * 8/2011 Lin ..... A47K 3/38 4/557
2006/0026748 A1 * 2/2006 Kwok ..... A47K 10/10 4/576.1
2014/0345814 A1 * 11/2014 Bar-lev ..... A47H 15/02 160/333

* cited by examiner

*Primary Examiner* — Ko H Chan
(74) *Attorney, Agent, or Firm* — Best & Flanagan LLP

(57) ABSTRACT

A shower curtain rod contains: multiple coupling posts and multiple rotatable connection assemblies. A respective one rotatable connection assembly includes: a first connector, a second connector, a flexible seat, and a fixing bolt. The first connector has a first locating portion and a first rotatable joining portion. The first rotatable joining portion has a through hole and multiple notches. The second connector has a second locating portion and a second rotatable joining portion. The second rotatable joining portion has two opposite tabs and an accommodation groove. The flexible seat is received in the accommodation groove and includes a sole plate and two side plates. A respective one side plate has a passing aperture, a positioning protrusion, and at least one elastic sheet. The fixing bolt is configured to rotatably connect the first rotatable joining portion in the trench between the two side plates.

6 Claims, 13 Drawing Sheets

SHOWER CURTAIN ROD CAPABLE OF ADJUSTING AN ANGLE

BACKGROUND OF THE INVENTION

Field of the Invention

The present invention relates to a shower curtain rod, and more particularly to the shower curtain rod which is capable of adjusting an angle.

Description of the Prior Art

A shower curtain is a curtain-shaped object that hangs outside a bathtub with a shower head in the bathroom or in the shower area. It is mainly used to prevent the splash of the shower from splashing outside the shower and to shield the person in the shower. The shower curtain is supported by the shower curtain rod during use. Depending on the structure of the bathroom, it is sometimes necessary to make the shower curtain rod into a curved shape for use. However, the conventional shower curtain rod is mostly one-piece formed or obtained by welding two shower curtain rods, which is not applicable. In various environments, when the angle of the shower curtain rod needs to be adjusted, the shower curtain rod needs to be replaced.

Therefore, an angle-adjustable shower curtain bracket is developed and includes a plurality of rods pivotally connected to each other, and each of the two adjacent rods is respectively provided with a convex seat and a concave seat, the convex seat and the concave seat. The threaded holes and through holes, the convex seat and the concave seat are connected, bolts pass through the through holes to lock the threaded holes, adjust and set an angle of each of the two adjacent rods, and then is locked securely.

The present invention has arisen to mitigate and/or obviate the afore-described disadvantages.

SUMMARY OF THE INVENTION

The primary object of the present invention is to provide a shower curtain rod which is adjustably rotated to a desired angle without using any tools easily and quickly.

Another object of the present invention is to provide a shower curtain rod which is fixed automatically after being adjustably rotated to the desired angle, thus avoiding a movement of the shower curtain rod after adjustably rotating the shower curtain rod.

To obtain above-mentioned aspects, a shower curtain rod provided by the present invention contains: multiple coupling posts and multiple rotatable connection assemblies, the multiple coupling posts is rotatably connected by using the multiple rotatable connection assemblies, and a respective one rotatable connection assembly is defined between any two adjacent coupling posts. The respective one rotatable connection assembly includes: a first connector, a second connector, a flexible seat, and a fixing bolt.

The first connector has a first locating portion formed on a first end of the first connector and fitted on one of any two adjacent coupling posts, and the first connector further includes a first rotatable joining portion formed on a second end of the first connector. The first rotatable joining portion has two opposite surfaces on which a through hole passes, and multiple notches are defined on the two opposite surfaces of the first rotatable joining portion and around the through hole.

The second connector has a second locating portion formed on a first end of the second connector and fitted on the other of any two adjacent coupling posts, and the second connector further has a second rotatable joining portion formed on a second end of the second connector. The second rotatable joining portion has two opposite tabs and an accommodation groove defined between the two opposite tabs, and a respective one tab has a locking orifice.

The flexible seat is received in the accommodation groove of the second connector, and the flexible seat includes a sole plate and two side plates symmetrically bent from two sides of the sole plate. The sole plate is fixed on a bottom of the accommodation groove, a trench is defined between the two side plates and is configured to accommodate the first rotatable joining portion of the first connector, the two side plates abut against the two tabs of the second connector. A respective one side plate has a passing aperture, a positioning protrusion extending to the trench from an end of the respective one side plate away from the sole plate, and at least one elastic sheet extending to the two tabs. The positioning protrusion of the respective one side plate engages with one of the multiple notches of the first rotatable joining portion, and the at least one elastic sheet of the respective one side plate abuts against the recess of the respective one tab of the second connector.

The fixing bolt inserted through the locking orifice of the respective one tab, the passing aperture of the respective one side plate, and the through hole of the first rotatable joining portion so as to rotatably connect the first rotatable joining portion in the trench between the two side plates, and the first rotatable joining portion is rotated with respect to the second rotatable joining portion along the fixing bolt.

DETAILED DESCRIPTION OF THE PREFERRED EMBODIMENTS

Figure 1:
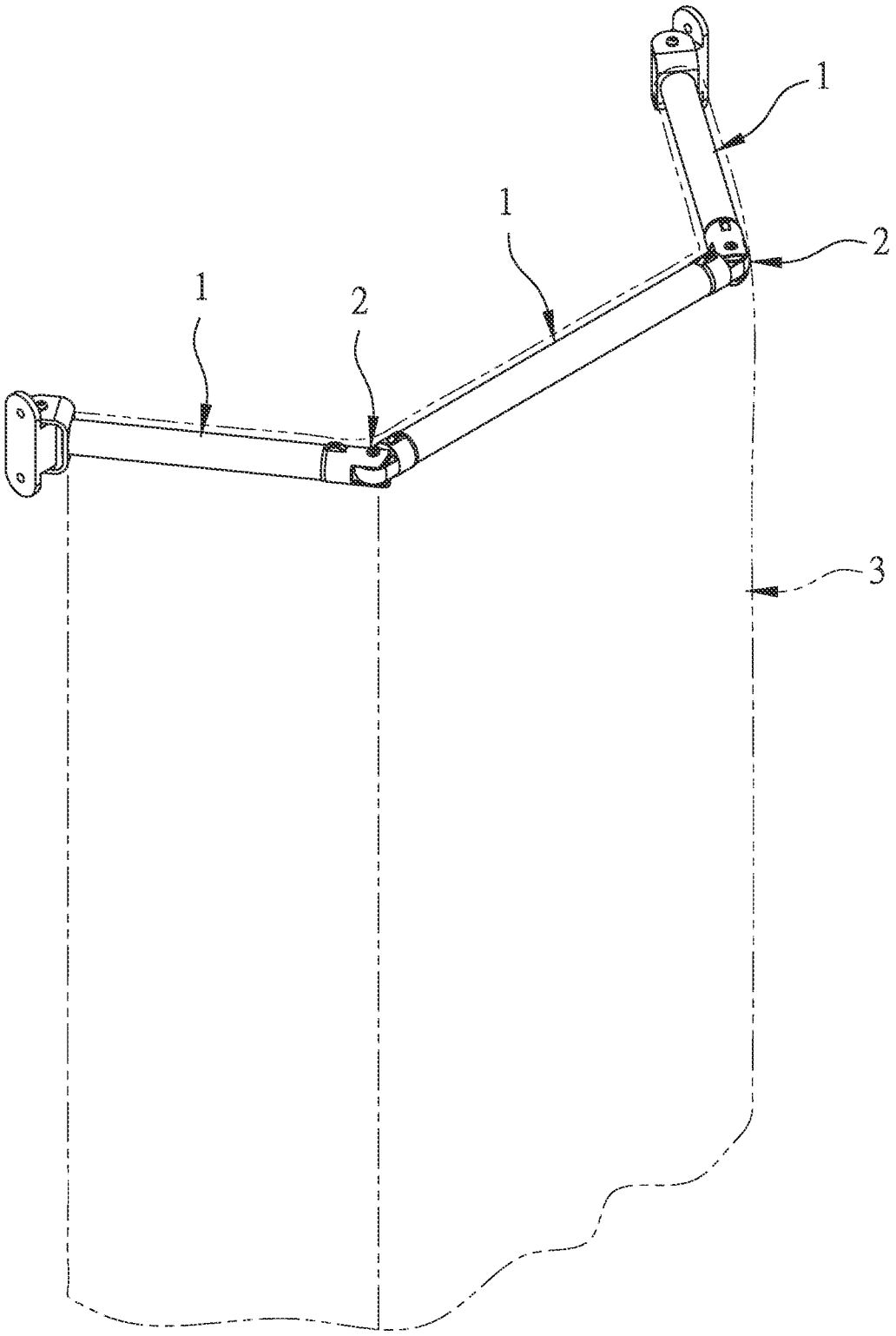
FIG. 1 is a perspective view showing the assembly of a shower curtain rod according to a preferred embodiment of the present invention.
Figure 2:
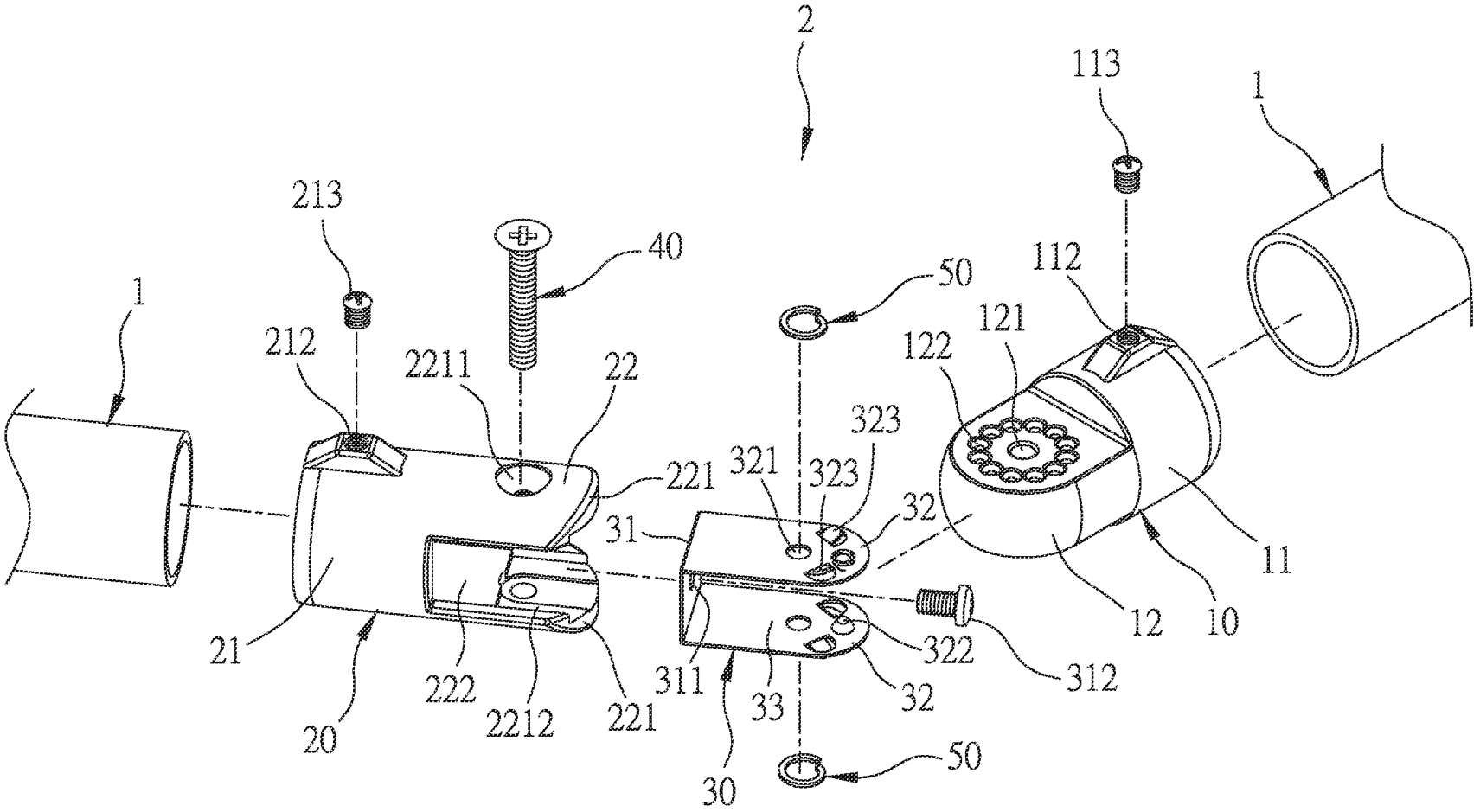
FIG. 2 is a perspective view showing the exploded components of the shower curtain rod according to the preferred embodiment of the present invention.
Figure 2A:
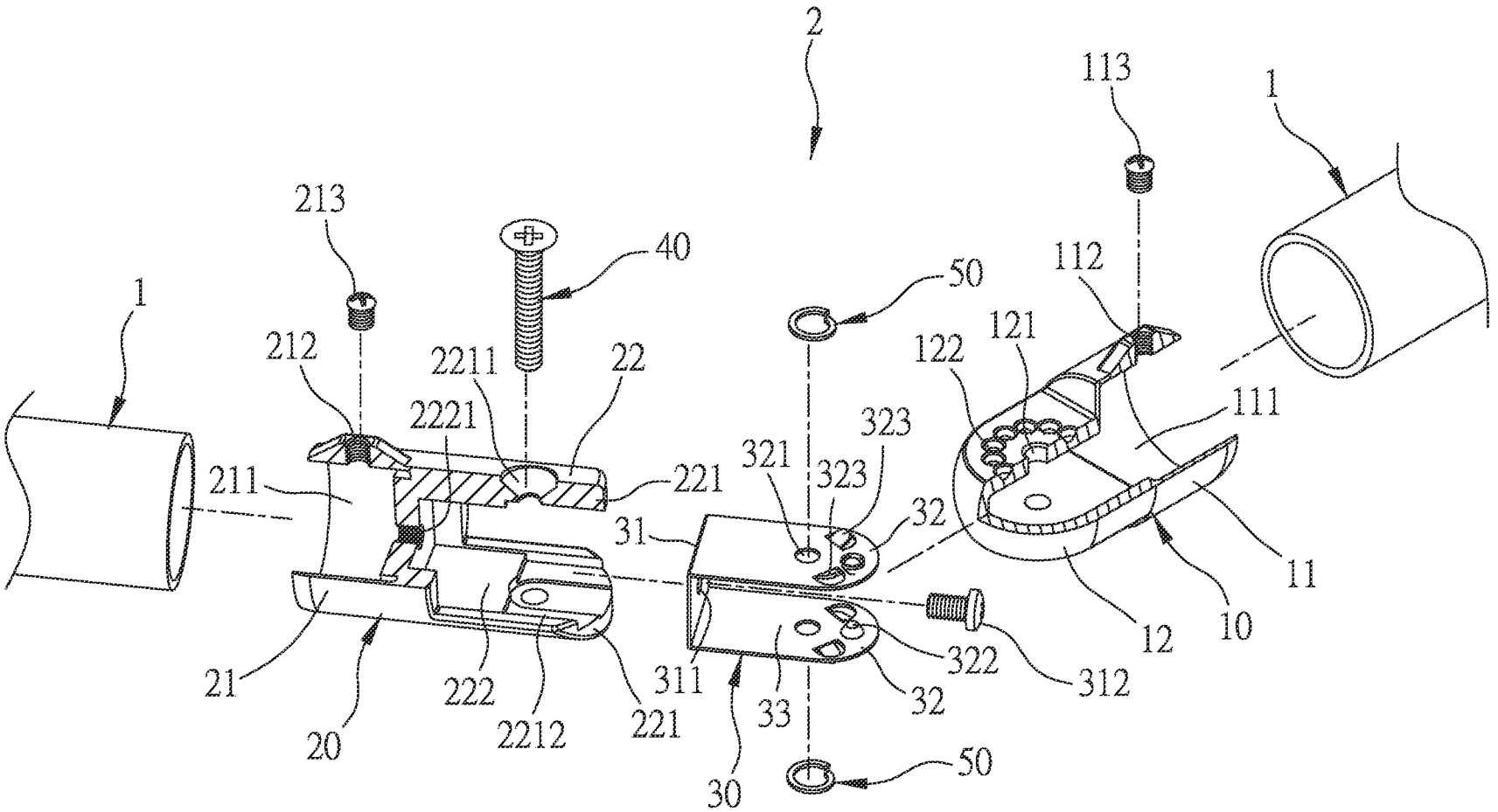
FIG. 2A is a cross sectional perspective view showing the assembly of a part of the shower curtain rod according to the preferred embodiment of the present invention.
Figure 3:
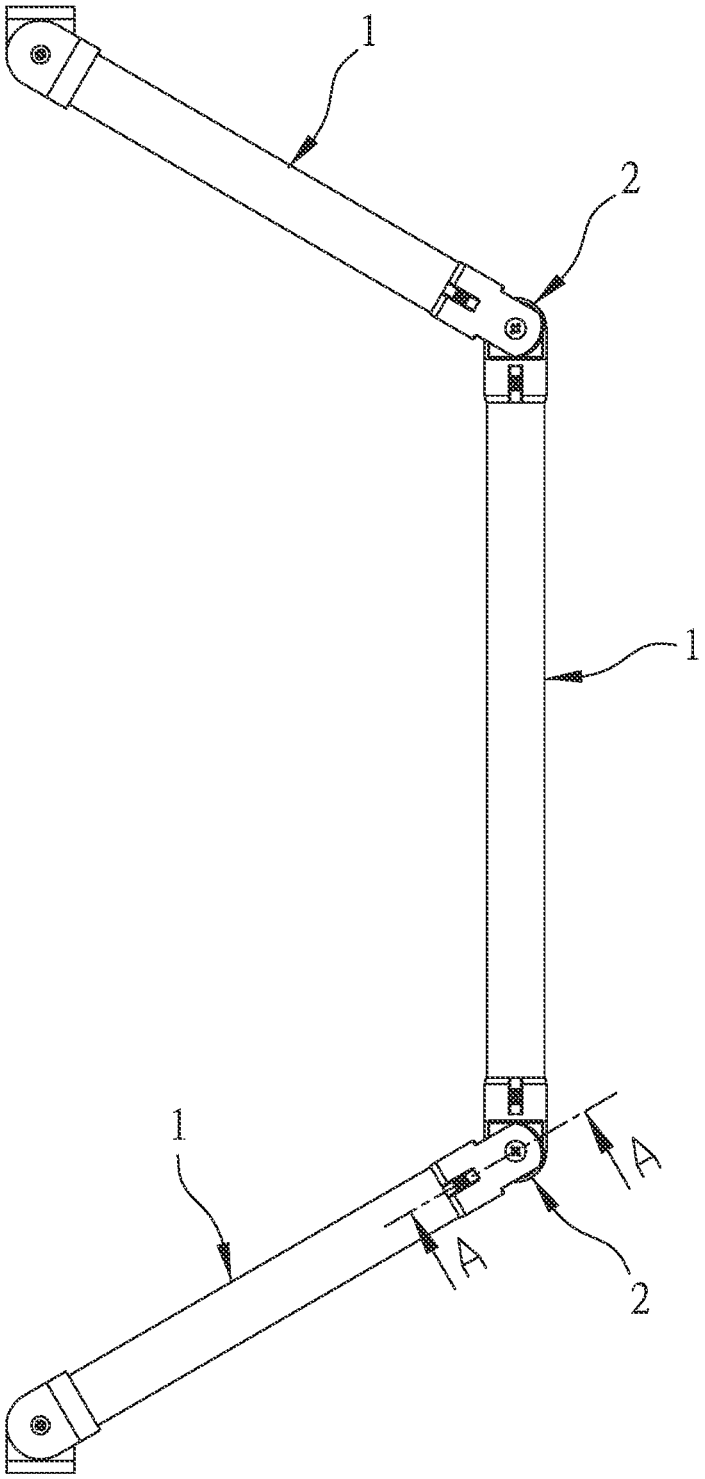
FIG. 3 is a top plan view showing the assembly of the shower curtain rod according to the preferred embodiment of the present invention.
Figure 4:
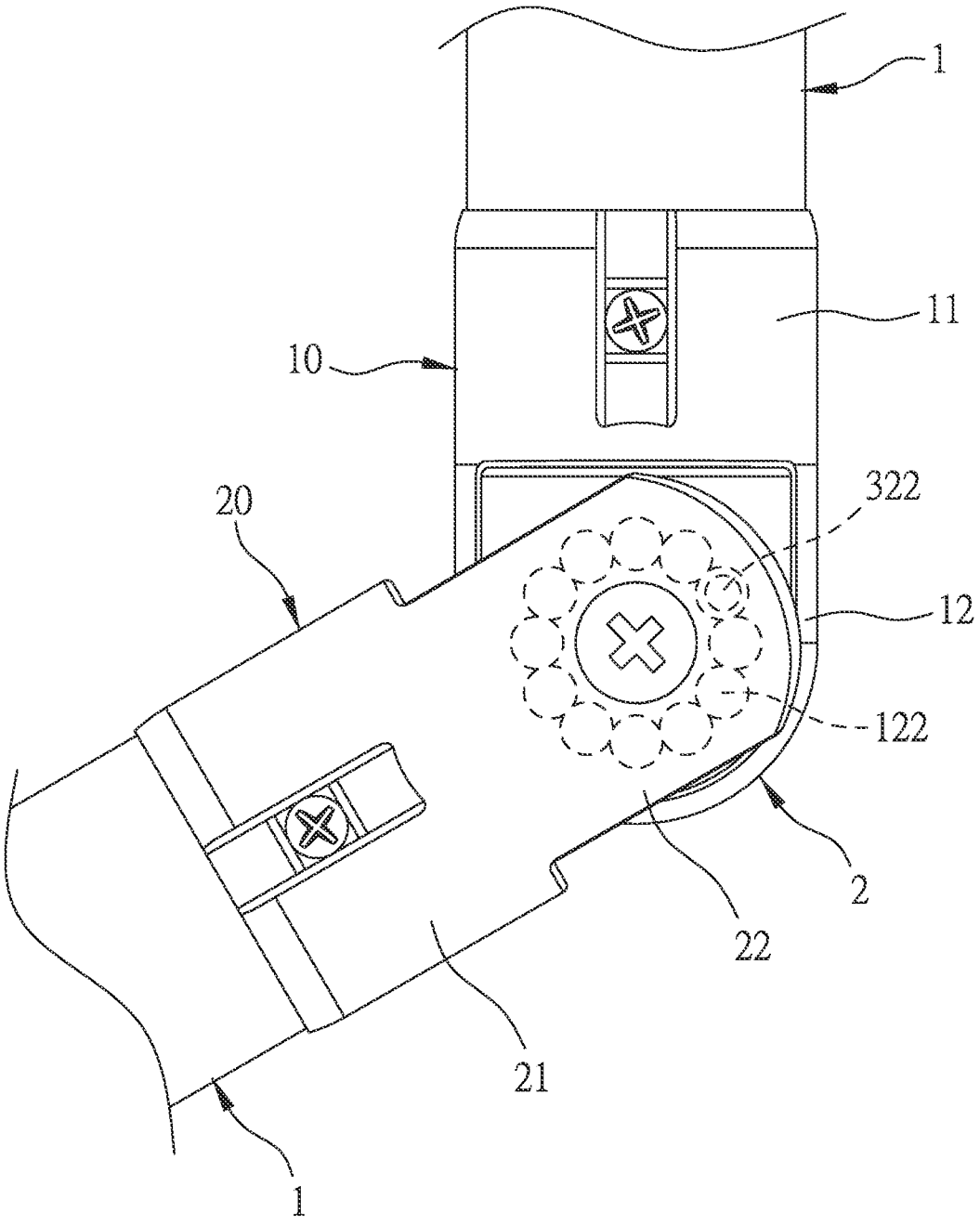
FIG. 4 is an amplified top plan view showing the assembly of the shower curtain rod according to the preferred embodiment of the present invention.
Figure 5:
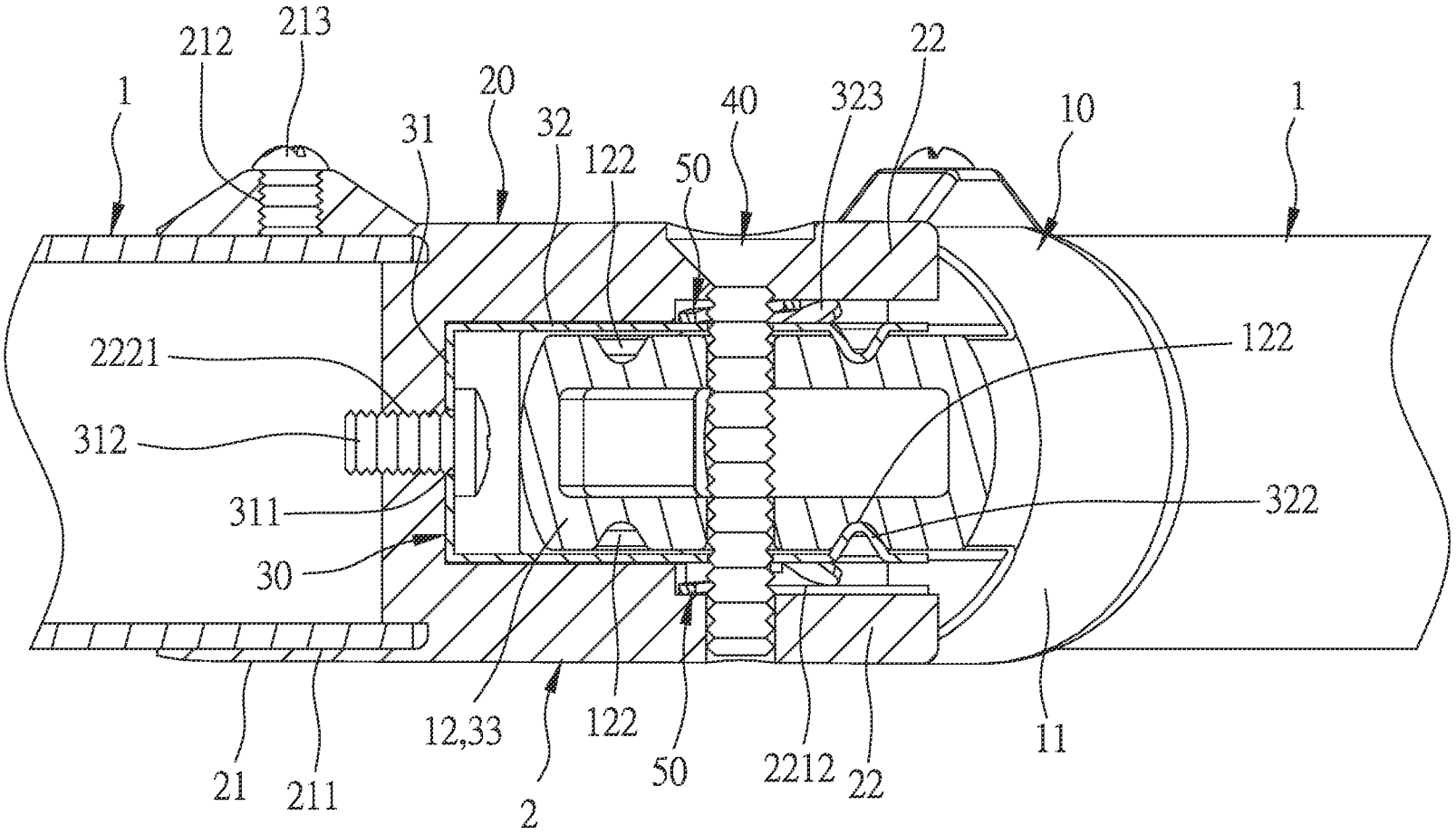
FIG. 5 is a cross sectional view taken along the line A-A of FIG. 3.

The present invention will be clearer from the following description when viewed together with the accompanying drawings, which show, for purpose of illustrations only, a preferred embodiment in accordance with the present invention.

With reference to FIGS. 1-5, a shower curtain rod capable of adjusting an angle according to a preferred embodiment of the present invention comprises: multiple coupling posts 1 and multiple rotatable connection assemblies 2, the multiple coupling posts 1 are rotatably connected by using the multiple rotatable connection assemblies 2, and a respective one rotatable connection assembly 2 is defined between any two adjacent coupling posts 1, such that a shower curtain 3 is hung on the shower curtain rod by way of the multiple coupling posts 1 and the multiple rotatable connection assemblies 2. The respective one rotatable connection assembly 2 includes a first connector 10, a second connector 20, a flexible seat 30, a fixing bolt 40, and two flexible spring washers 50.

The first connector 10 has a first locating portion 11 formed on a first end thereof and fitted on one of any two adjacent coupling posts 1, and the first connector 10 further has a first rotatable joining portion 12 formed on a second end of the first connector 10, wherein the first locating portion 11 has a first receiving orifice 111 defined thereon and configured to receive the one adjacent coupling post 1, a first threaded orifice 112 formed on the first locating portion 11 and communicating with the first receiving orifice 111, a first screw element 113 screwed with the first threaded orifice 112 to force the one coupling post 1 in the first receiving orifice 111 tightly. The first rotatable joining portion 12 has two opposite surfaces on which a through hole 121 passes, and multiple notches 122 are defined on the two opposite surfaces of the first rotatable joining portion 12 and around the through hole 121.

The second connector 20 has a second locating portion 21 formed on a first end thereof and fitted on the other of any two adjacent coupling posts 1, and the second connector 20 further has a second rotatable joining portion 22 formed on a second end of the second connector 20, wherein the second locating portion 21 has a second receiving orifice 211 defined thereon and configured to receive the other coupling post 1, a second threaded orifice 212 formed on the second locating portion 21 and communicating with the second threaded receiving orifice 211, a second screw element 213 screwed with the second threaded orifice 212 to force the other coupling post 1 in the second receiving orifice 211 tightly. The second rotatable joining portion 22 has two opposite tabs 221 and an accommodation groove 222 defined between the two opposite tabs 221, wherein a respective one tab 221 has a locking orifice 2211 and a recess 2212 facing to the accommodation groove 222, and the accommodation groove 222 has a third threaded orifice 2221 defined on a bottom thereof.

The flexible seat 30 is received in the accommodation groove 222 of the second connector 20, and the flexible seat 30 includes a sole plate 31 and two side plates 32 symmetrically bent from two sides of the sole plate 31, wherein the sole plate 31 has a defining orifice 311 configured to receive a third screw element 312 and screwed with the third threaded orifice 2221 of the bottom of the accommodation groove 222, such that the sole plate 31 is fixed on the bottom of the accommodation groove 222. A trench 33 is defined between the two side plates 32 and is configured to accommodate the first rotatable joining portion 12 of the first connector 10, the two side plates 32 abut against the two tabs 221 of the second connector 20, wherein a respective one side plate 32 has a passing aperture 321, a positioning protrusion 322 extending to the trench 33 from an end of the respective one side plate 32 away from the sole plate 31, and at least one elastic sheet 323 extending to the two tabs 221 (in this embodiment, two elastic sheets 323 extend to the two tabs 221), wherein the positioning protrusion 322 of the respective one side plate 32 engages with one of the multiple notches 122 of the first rotatable joining portion 12, and the at least one elastic sheet 323 of the respective one side plate 32 abuts against the recess 2212 of the respective one tab 221 of the second connector 20.

The fixing bolt 40 is inserted through the locking orifice 2211 of the respective one tab 221, the passing aperture 321 of the respective one side plate 32, and the through hole 121 of the first rotatable joining portion 12 so as to rotatably connect the first rotatable joining portion 12 in the trench 33 between the two side plates 32, and the first rotatable joining portion 12 is rotated with respect to the second rotatable joining portion 22 along the fixing bolt 40.

The two flexible spring washers 50 are mounted among the two side plates 32 of the flexible seat 30 and two recesses 2212 of the two tabs 221, and the two flexible spring washers 50 are fitted with the fixing bolt 40.

Figure 6:
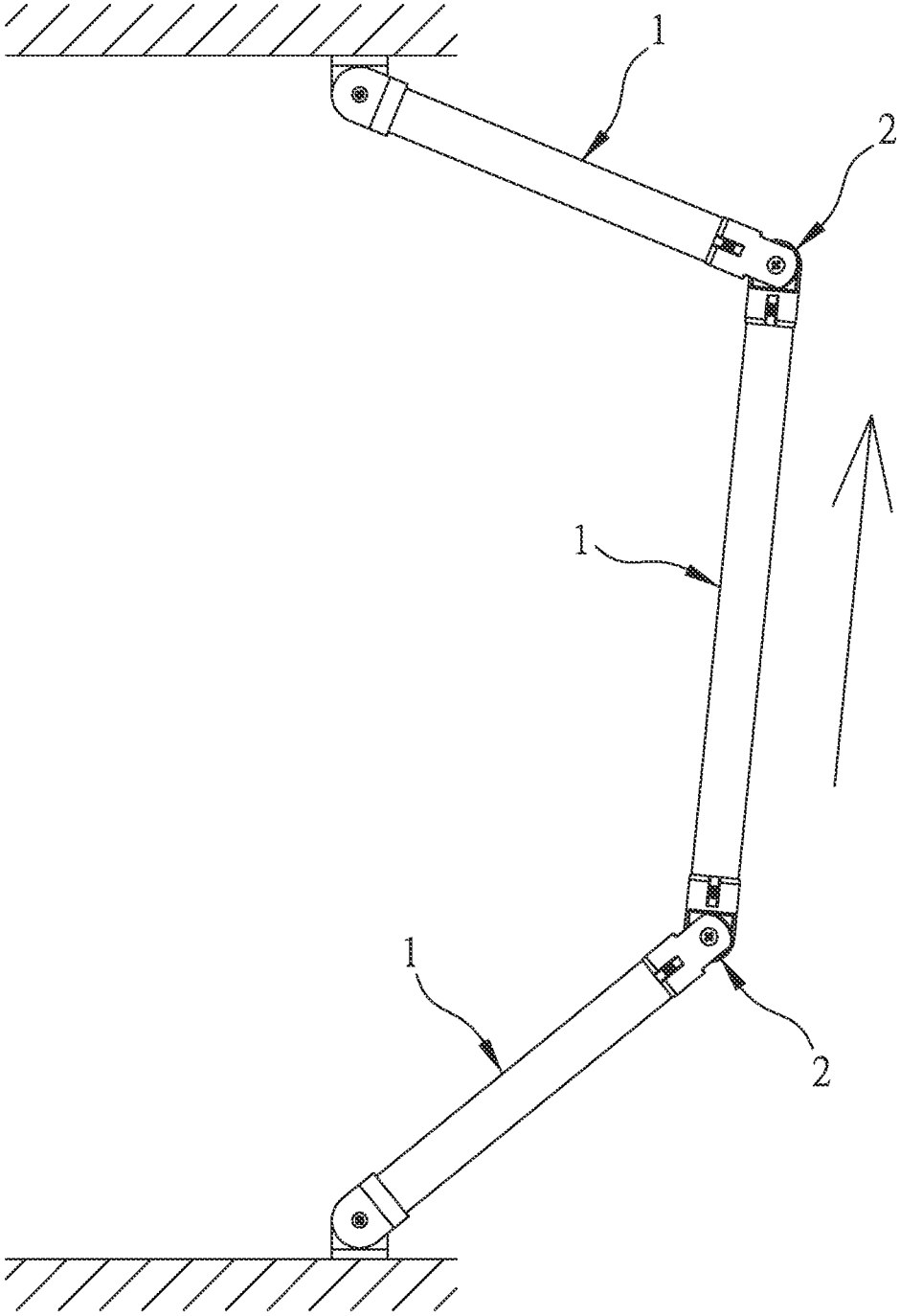
FIG. 6 is a top plan view showing the operation of the shower curtain rod according to the preferred embodiment of the present invention.
Figure 7:
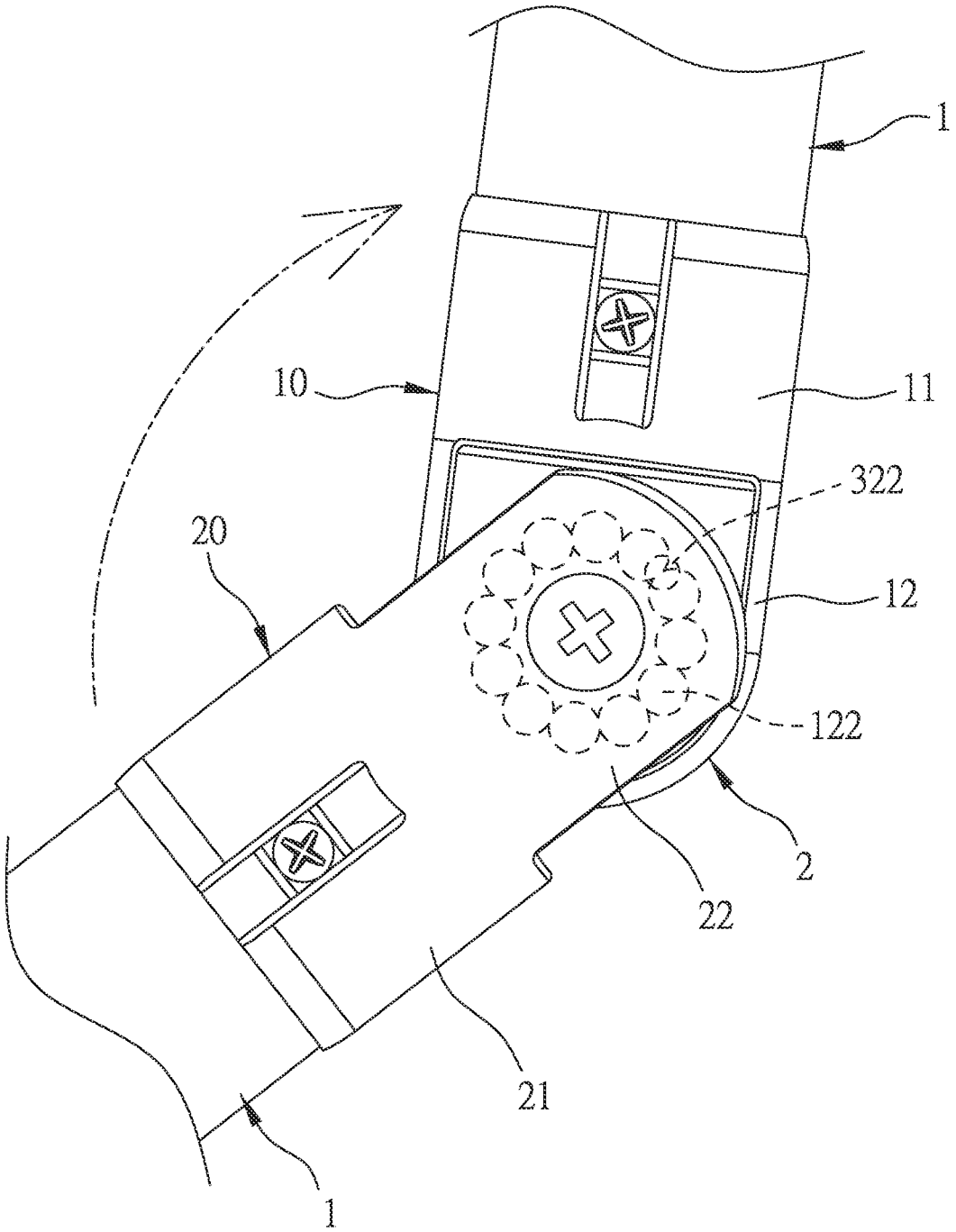
FIG. 7 is a top plan view showing the operation of a part of the shower curtain rod according to the preferred embodiment of the present invention.
Figure 8:
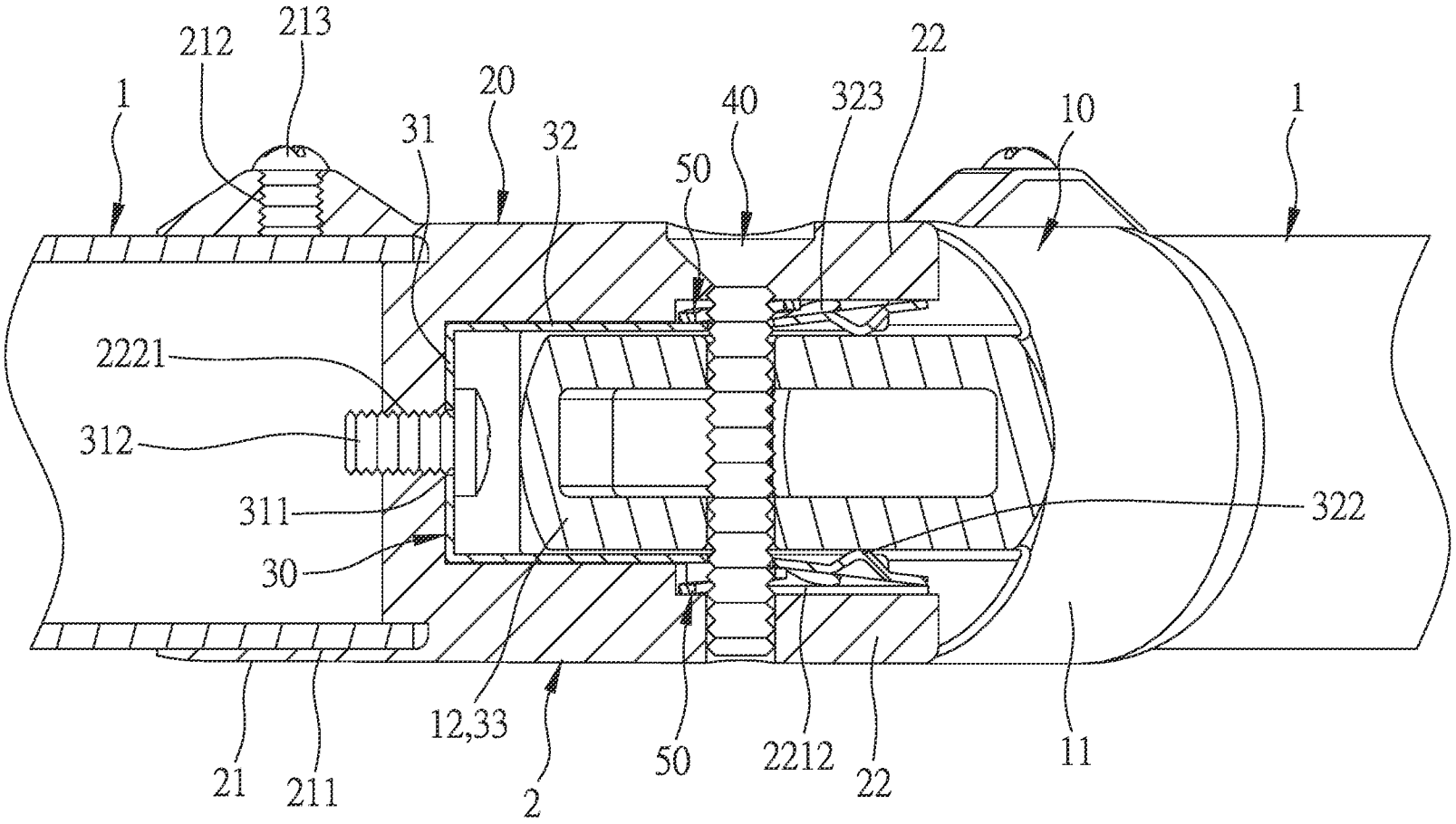
FIG. 8 is a cross sectional view showing the operation of the shower curtain rod according to the preferred embodiment of the present invention.
Figure 9:
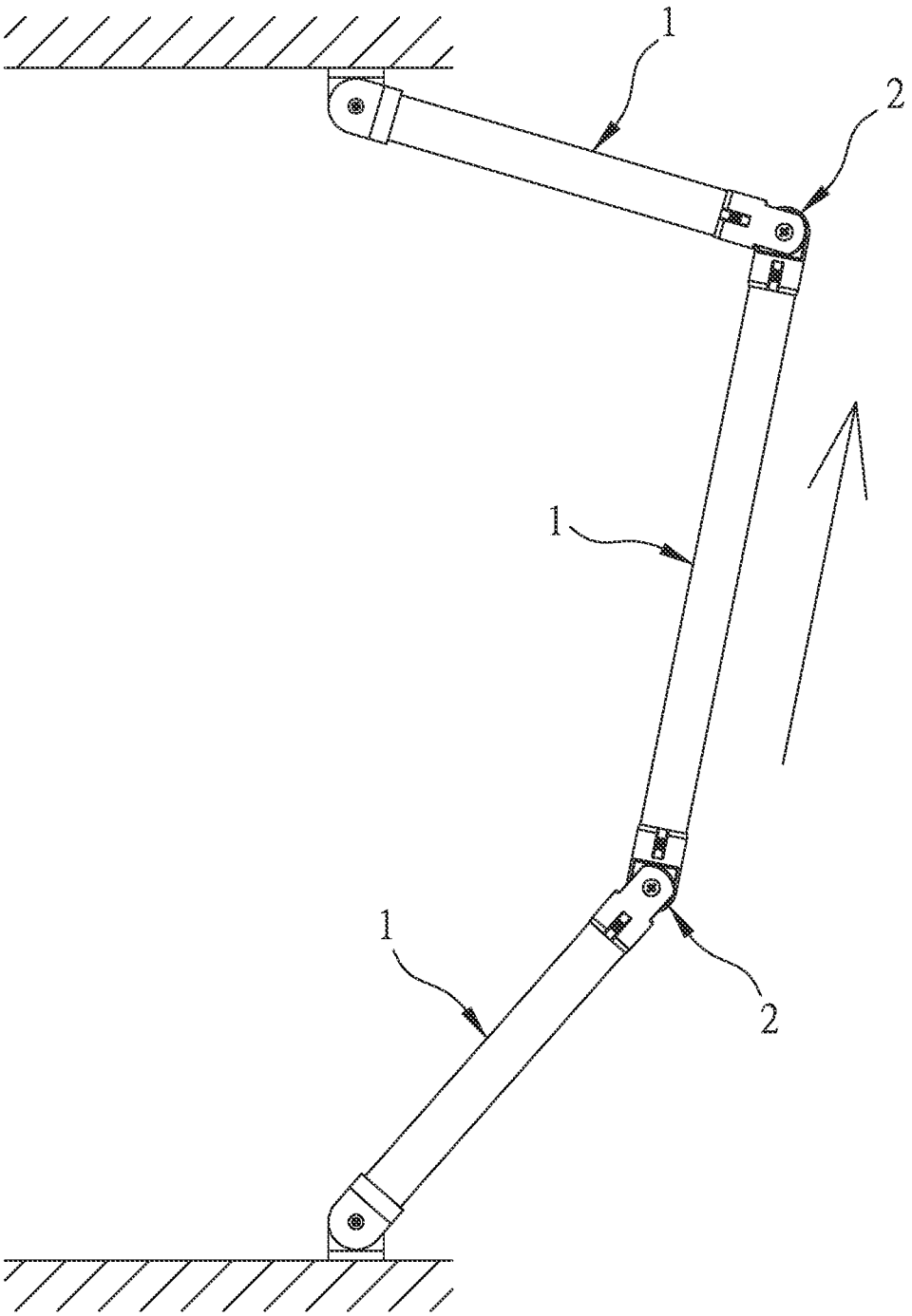
FIG. 9 is another top plan view the operation of the shower curtain rod according to the preferred embodiment of the present invention.
Figure 10:
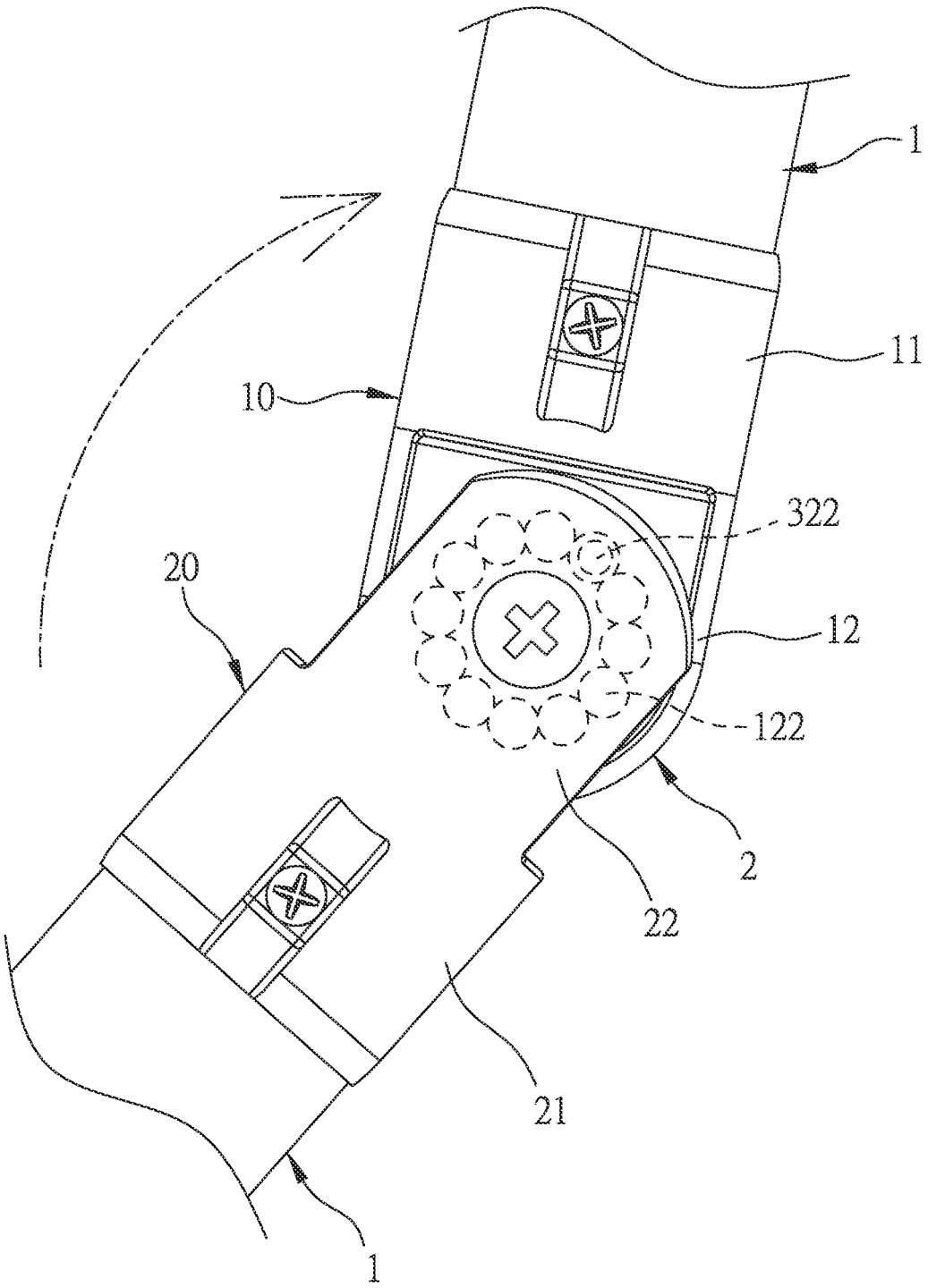
FIG. 10 is another top plan view showing the operation of a part of the shower curtain rod according to the preferred embodiment of the present invention.
Figure 11:
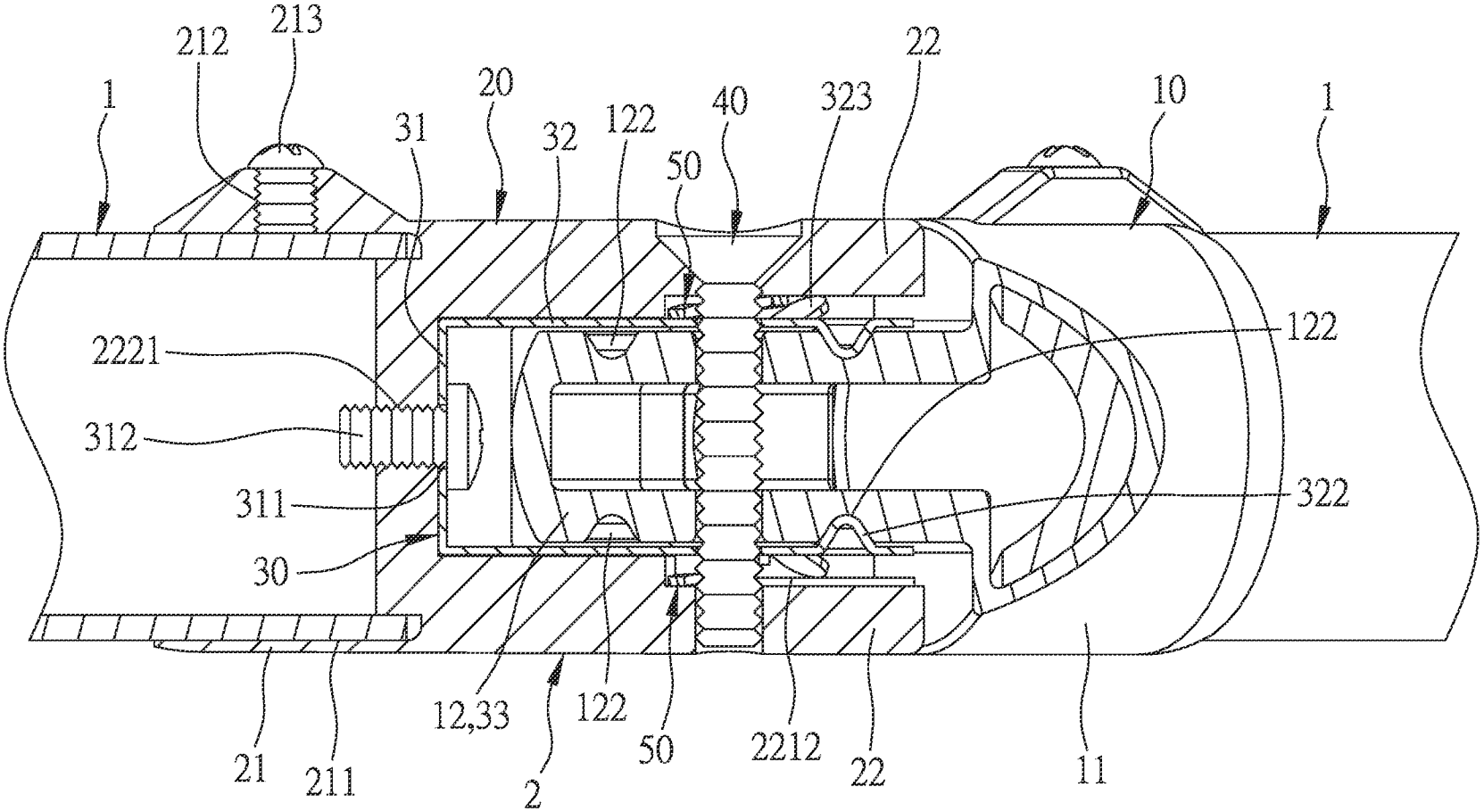
FIG. 11 is another cross sectional view showing the operation of the shower curtain rod according to the preferred embodiment of the present invention.

When adjusting an angle of the shower curtain rod, as shown in FIGS. 6-8, any two adjacent coupling posts 1 are rotated directly so that the first rotatable joining portion 12 and the second rotatable joining portion 22 of the respective one rotatable connection assembly 2 between any two adjacent coupling posts 1 are rotated along the fixing bolt 40, and the at least one elastic sheet 323 of the respective one side plate 32 and a respective one flexible spring washers 50 are pressed, such that the respective one side plate 32 of the flexible seat 30 deforms to a respective one recess 2212 of a respective one tabs 221, and the positioning protrusion 322 of the respective one side plate 32 removes from the one notch 122 of the first rotatable joining portion 12. When adjusting any two adjacent coupling posts 1 to the desired angle, as illustrated in FIGS. 9-11, the at least one elastic sheet 323 of the respective one side plate 32 and the respective one flexible spring washers 50 are pushed to force the respective one side plate 32 of the flexible seat 30 back to an original position, and the positioning protrusion 322 of the respective one side plate 32 engages with the one notch 122 of the first rotatable joining portion 12, thus adjusting the angle of the shower curtain rod.

Figure 12:
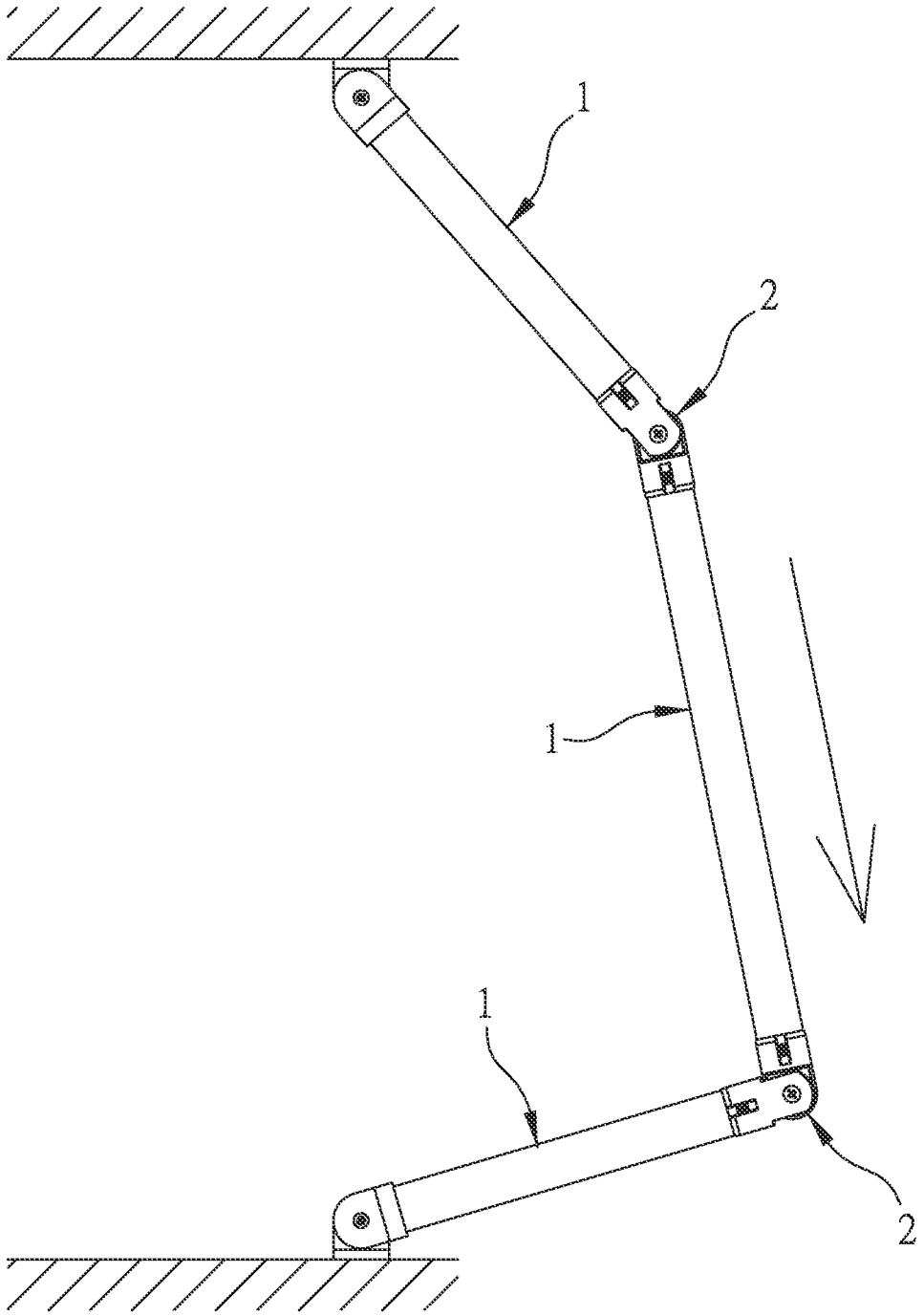
FIG. 12 is still another top plan view the operation of the shower curtain rod according to the preferred embodiment of the present invention.

Referring further to FIG. 12, the shower curtain rod is adjustably rotated to another angle, thus obtaining various using requirements.

Thereby, the shower curtain rod has advantages as follows:

1. The shower curtain rod is adjustably rotated to the desired angle without using any tools easily and quickly.
2. The shower curtain rod is fixed automatically after being adjustably rotated to the desired angle, thus avoiding a movement of the shower curtain rod after adjustably rotating the shower curtain rod.

While various embodiments in accordance with the present invention have been shown and described, it is clear to those skilled in the art that further embodiments may be made without departing from the scope of the present invention.

What is claimed is:

1. A shower curtain rod comprising multiple coupling posts and multiple rotatable connection assemblies, the multiple coupling posts being rotatably connected by using the multiple rotatable connection assemblies, and a respective one rotatable connection assembly being defined between any two adjacent coupling posts; wherein the respective one rotatable connection assembly includes:

a first connector having a first locating portion formed on a first end of the first connector and fitted on one of any two adjacent coupling posts, and the first connector further having a first rotatable joining portion formed on a second end of the first connector, wherein the first rotatable joining portion has two opposite surfaces on which a through hole passes, and multiple notches are defined on the two opposite surfaces of the first rotatable joining portion and around the through hole;

a second connector having a second locating portion formed on a first end of the second connector and fitted on the other of any two adjacent coupling posts, and the second connector further having a second rotatable joining portion formed on a second end of the second connector, wherein the second rotatable joining portion has two opposite tabs and an accommodation groove defined between the two opposite tabs, and a respective one tab has a locking orifice;

a flexible seat received in the accommodation groove of the second connector, and the flexible seat includes a sole plate and two side plates symmetrically bent from two sides of the sole plate, wherein the sole plate is fixed on a bottom of the accommodation groove, a trench is defined between the two side plates and is configured to accommodate the first rotatable joining portion of the first connector, the two side plates abut against the two tabs of the second connector, wherein a respective one side plate has a passing aperture, a positioning protrusion extending to the trench from an end of the respective one side plate away from the sole plate, and at least one elastic sheet extending to the two tabs, wherein the positioning protrusion of the respective one side plate engages with one of the multiple notches of the first rotatable joining portion, and the at least one elastic sheet of the respective one side plate abuts against the respective one tab of the second connector; and a fixing bolt inserted through the locking orifice of the respective one tab, the passing aperture of the respective one side plate, and the through hole of the first rotatable joining portion so as to rotatably connect the first rotatable joining portion in the trench between the two side plates, and the first rotatable joining portion is rotated with respect to the second rotatable joining portion along the fixing bolt.

2. The shower curtain rod as claimed in claim 1, wherein the first locating portion of the first connector has a first receiving orifice defined thereon and configured to receive the one adjacent coupling post, a first threaded orifice formed on the first locating portion and communicating with the first receiving orifice, a first screw element screwed with the first threaded orifice to force the one coupling post in the first receiving orifice tightly.

3. The shower curtain rod as claimed in claim 1, wherein the second locating portion has a second receiving orifice defined thereon and configured to receive the other coupling post, a second threaded orifice formed on the second locating portion and communicating with the second receiving orifice, a second screw element screwed with the second threaded orifice to force the other coupling post in the second receiving orifice tightly.

4. The shower curtain rod as claimed in claim 1, wherein a respective one tab of the second connector has a recess facing to the accommodation groove, and the recess of the respective one tab of the second connector abuts against the at least one elastic sheet of the respective one side plate.

5. The shower curtain rod as claimed in claim 1, wherein the accommodation groove of the second connector has a third threaded orifice defined on the bottom thereof, the sole plate has a defining orifice configured to receive a third screw element and screwed with the third threaded orifice of the bottom of the accommodation groove, such that the sole plate is fixed on the bottom of the accommodation groove.

6. The shower curtain rod as claimed in claim 1, wherein two flexible spring washers are mounted among the two side plates of the flexible seat and two recesses of the two tabs, and the two flexible spring washers are fitted with the fixing bolt.

* * * * *